US006902032B2

(12) United States Patent
Diggle et al.

(10) Patent No.: US 6,902,032 B2
(45) Date of Patent: Jun. 7, 2005

(54) TECHNICIAN CATCHER

(75) Inventors: Frederick James Diggle, Birmingham, AL (US); Edward Alvin Brazier, Birmingham, AL (US)

(73) Assignee: BellSouth Intellectual Property Corporation, Wilmington, DE (US)

( * ) Notice: Subject to any disclaimer, the term of this patent is extended or adjusted under 35 U.S.C. 154(b) by 32 days.

(21) Appl. No.: 10/609,888

(22) Filed: Jun. 30, 2003

(65) Prior Publication Data

US 2004/0262081 A1 Dec. 30, 2004

(51) Int. Cl.[7] ..... A47L 3/04; A63B 27/00
(52) U.S. Cl. ..... 182/9; 182/133
(58) Field of Search ..... 182/9, 134–136, 182/187, 188, 133

(56) References Cited

U.S. PATENT DOCUMENTS 711,251 A * 10/1902 Knop ..... 182/134
2,392,538 A * 1/1946 Knudsen ..... 182/134
2,842,300 A 7/1958 Johnson
2,879,830 A 3/1959 Johnson
2,920,714 A 1/1960 Johnson
3,407,898 A * 10/1968 Johnson ..... 182/9
4,407,391 A 10/1983 Greenway et al.
4,427,092 A 1/1984 Tentler
4,527,660 A 7/1985 Andruchiw
4,595,078 A 6/1986 Greenway
4,747,468 A * 5/1988 Greenway ..... 182/9
5,257,677 A 11/1993 Stepp
6,016,891 A 1/2000 Sava
6,206,138 B1 3/2001 Yerger
6,241,045 B1 6/2001 Reeve et al.

* cited by examiner

*Primary Examiner*—Hugh B. Thompson, II
(74) *Attorney, Agent, or Firm*—Bambi F. Walters, Esq.; Walters and Zimmerman

(57) ABSTRACT

This invention provides apparatus and methods of use for a technician catcher safety device having the means to securely engage the pole so that the safety device can hold or otherwise support a safety strap attached to the fallen technician. In various embodiments, the safety device includes a pair of main lever arms interconnected by a central connecting portion. The ends of the main lever arms include elbows that merge into upwardly extending arms.

17 Claims, 12 Drawing Sheets

TECHNICIAN CATCHER

NOTICE OF COPYRIGHT PROTECTION

A portion of the disclosure of this patent document and its figures contain material subject to copyright protection. The copyright owner has no objection to the facsimile reproduction by anyone of the patent document or the patent disclosure, but otherwise reserves all copyrights whatsoever.

BACKGROUND OF THE INVENTION

1. Field of the Invention

This invention relates generally to safety devices and methods for use by a technician and other person of similar occupation when climbing a pole, such as poles carrying telephone lines or electrical power lines.

2. Description of the Related Art

In the telecommunications or electronics industry, it is common practice for a technician (also referred to as a "linesman") to climb a pole to install equipment, to repair broken or damaged communications equipment, to test equipment, and/or other work-related reasons. In order to safely and effectively climb a pole and perform line work, the technician must maintain and properly utilize various types of climbing equipment. To utilize the various types of climbing equipment, the technician must also have the skills and the physical ability to sustain a great strain on their legs and back while the technician climbs and/or maintains a position about the pole.

Conventional climbing equipment employed by a technician typically includes a pair of gaffs, a body belt, and/or a safety strap. In general, the gaff is a sharp blade protruding from the inside of the foot about mid-foot level and having straps that secure about the leg and/or feet of a technician. To climb, the technician drives one of the gaffs into the pole, steps up onto the gaff, and then drives the other gaff into the pole at a higher position. The technician continues taking steps up or "gaffs up" the pole until reaching a desired height.

The body belt is secured around the waist of the technician. The body belt includes pockets for carrying tools and rings (e.g., "D-rings") for attaching the safety strap. The safety strap typically includes a hook (e.g., snap buckle) at each end and a buckle for adjusting its length. During climbing, both hooks of the safety strap are attached to the same ring of the body belt on the left hip. Once in a position to perform line work, the technician releases one end of the safety strap from the body belt and wraps the safety strap around the pole. The technician then reattaches the end of the safety strap to the right D-ring on the body belt, thus allowing the technician to use his hands at the desired working elevation. Thus, the technician uses the safety strap for climbing as well as supporting the technician in his working position about the pole.

During elevated line work, both gaffs are pressed into the pole and the technician leans back against the safety strap. This position allows the weight of the technician to be supported by the gaffs and the tension in the safety strap. An error in technique or defect in equipment, however, may result in serious injury to the technician. For example, there are times when a gaff dislodges or "cuts out" from the pole. If one or both of the gaffs cuts out, the technician may (i) fall straight down from atop the pole, (ii) rotate downward and fall on the head, (iii) get one or more gaffs back into the pole, and (iv) may reach out to grab/hug the pole. In many of these scenarios, the technician may, and often does, sustain injury such as to the knees, back, and/or arms.

Safety devices have been proposed for supporting the weight of the technician to prevent accidents as described above; however, the usefulness of such safety devices depends upon the willingness of the technician to use them which in turn relies upon wnether such devices are conveniently and easily used in the field. As an alternative to climbing the pole, some technicians resort to using ladders or bucket trucks to perform elevated line work so as to avoid the risk of injury from a fall. This solution requires the purchase and maintenance of additional equipment and, thus, results in increased expenses for the technician's employer. In addition, work related injuries still occur when using and transporting a ladder of the size necessary to reach the top of a pole.

SUMMARY OF THE INVENTION

This invention addresses the above-described needs, and other needs, by providing a portable safety device that catches and supports a technician who has fallen from a columnar member, such as a pole, a tree trunk, and the like. According to an embodiment, a technician catcher safety device includes a frame having a pair of main lever arms interconnected by a central connecting portion. Each main lever arm divergently extends from the central connecting portion such that the frame extends about a variety of circumferences of a columnar member, that is, the technician catcher can easily be positioned about a portion of the circumference of many different sized columnar members. Each main lever arm includes an elbow at an end opposite the central connecting portion, and the elbow connects the main lever arm to an upwardly, extending arm. The upwardly, extending arm typically has an angle of approximately greater than thirty degrees (30°) and less than one hundred fifty degrees (150°) relative to the central connecting portion, such that the upwardly, extending arms are relatively perpendicular and/or angled towards the central connecting portion. When both a downward force and an inward force are exerted near the ends of the lever arms, such as when a technician has fallen and a safety strap of the technician is caught by the safety device, the pair of main lever arms securely engage the columnar member to support a suspended weight, such as the weight of the fallen technician. That is, the forces exerted near the ends of the lever arms squeeze the main lever arms together so that the technician catcher comes to a secure position on the pole to support the weight of the fallen technician.

In another embodiment, each of the main lever arms of the technician catcher safety device includes an upper surface, a lower surface, an inward surface, and an outward surface, and the inward surface includes one or more toothed gaffs. Typically, the toothed gaffs have an interior angle relative to the inward surface and the central connecting portion of about thirty five degrees or greater. In another embodiment, the technician catcher includes one or more ridge-like gripping surfaces along the inward surface of each main lever arm. In another embodiment the technician catcher safety device further includes chain means secured to one of the main lever arms and a mating link supporting arm. The chain means include a linked chain securely attached at a first end of the linked chain to the one of the main lever arms. The link supporting arm pivotally secures at an end to the other main lever arm and has a clip at an opposite end of the link supporting arm. In general, the end of the link supporting arm is positioned on a portion of the other main lever arm substantially opposite the chain means, such that the clip detachably engages a link of the linked chain to securely adjust the technician catcher into a desired position about the columnar member.

This invention further includes a method for ascending a columnar member to a desired working elevation and/or positioning the technician catcher safety device described in the above and other embodiments so that the safety device engages a columnar member such as a pole or a tree trunk.

BRIEF DESCRIPTION OF THE DRAWINGS

The above and other embodiments, objects, uses, advantages, and novel features of this invention are more clearly understood by reference to the following description taken in connection with the accompanying figures, in which.

DETAILED DESCRIPTION OF THE INVENTION

Figure 1:
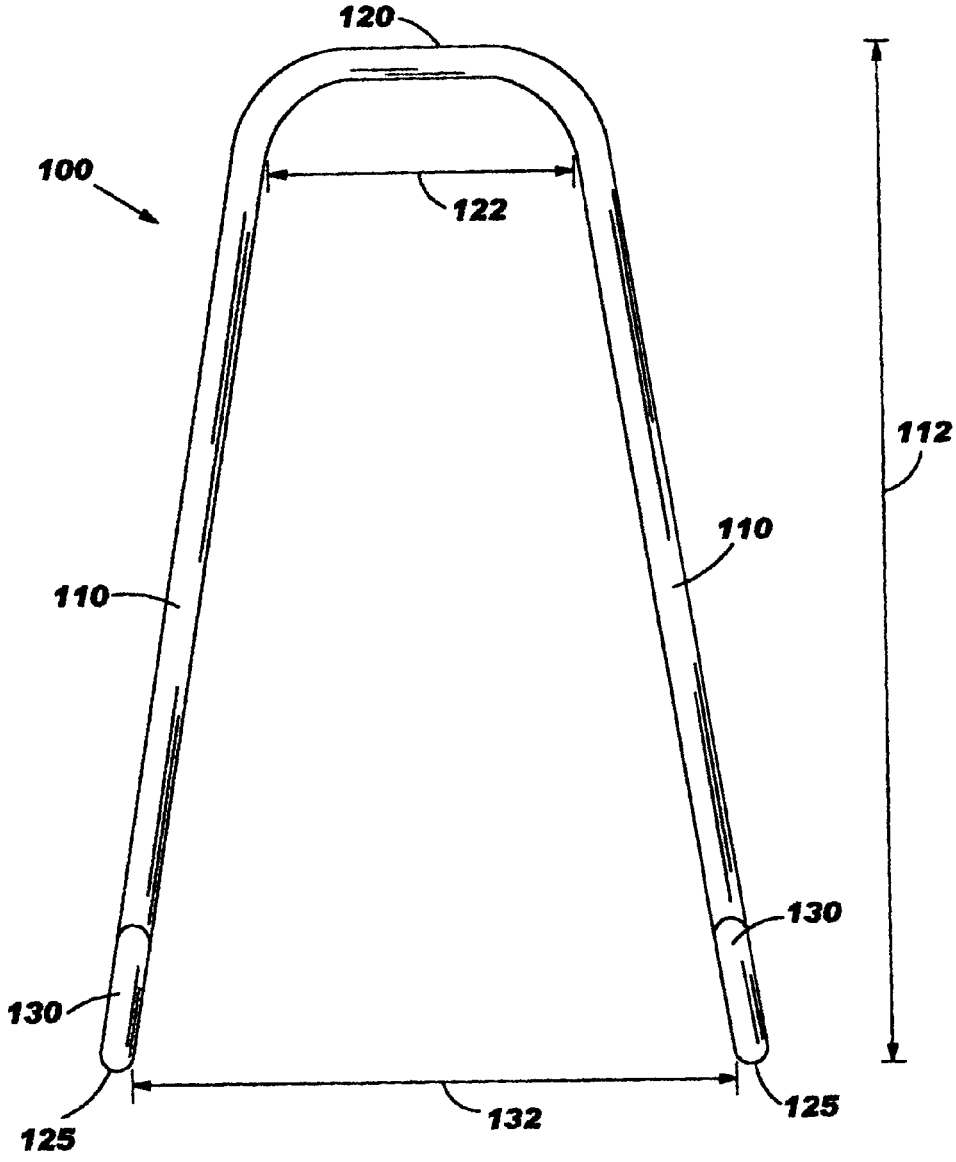
FIG. 1 is a perspective top view of a technician catcher safety device according to an embodiment of this invention.

This invention now will be described more fully hereinafter with reference to the accompanying drawings, in which exemplary embodiments are shown. This invention may, however, be embodied in many different forms and should not be construed as limited to the embodiments set forth herein; rather, these embodiments are provided so that this disclosure will be thorough and complete, and will fully convey the scope of the invention to those of ordinary skill in the art. Moreover, all statements herein reciting embodiments of the invention, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure). Thus, for example, it will be appreciated by those skilled in the art that the schematics and the like represent conceptual views of illustrative structures embodying this invention.

In the claims hereof any element expressed as a means for performing a specified function is intended to encompass any way of performing that function including, for example, a combination of elements that performs that function. The invention as defined by such claims resides in the fact that the functionalities provided by the various recited means are combined and brought together in the manner that the claims call for. Applicant thus regards any means that can provide those functionalities as equivalent as those shown herein.

This invention is directed to a portable safety device (herein also referred to as a "technician catcher safety device" and a "safety device") that catches and supports a technician who has fallen from a columnar member, such as a pole, a tree trunk, and the like. In an embodiment, a technician catcher safety device includes a frame having a pair of main lever arms interconnected by a central connecting portion. Each main lever arm divergently extends from the central connecting portion such that the frame extends about a variety of circumferences of a columnar member, that is, the frame can easily be positioned about a portion of the circumference of many different sized columnar members. Each main lever arm includes an elbow at an end opposite the central connecting portion, and the elbow connects the main lever arm to an upwardly, extending arm. The upwardly, extending arm typically has an angle of ninety degrees or less relative to the central connecting portion, such that the upwardly, extending arms are relatively perpendicular and/or angled towards the central connecting portion. When both a downward force and an inward force are exerted near the ends of the lever arms, such as when a technician has fallen and a safety strap of the technician is caught by the safety device, the pair of main lever arms securely engage the columnar member to support a suspended weight, such as the weight of the fallen technician. In various other embodiments, the technician catcher safety device further includes toothed gaffs, a lanyard tether, and/or chain means with a support link arm to better position the frame upon and/or about the columnar member. Still further, this invention includes methods for positioning a technician catcher safety device so that the safety device engages a columnar member and/or for catching a fallen technician.

Figure 2A:
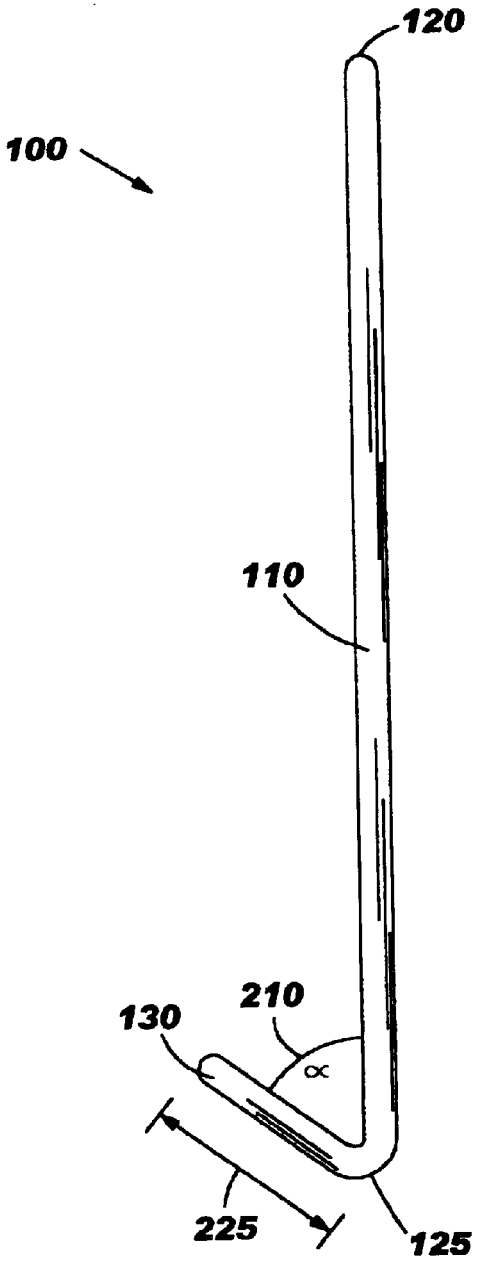
FIGS. 2A and 2B are perspective side views of the technician catcher safety device of FIG. 1.
Figure 2B:
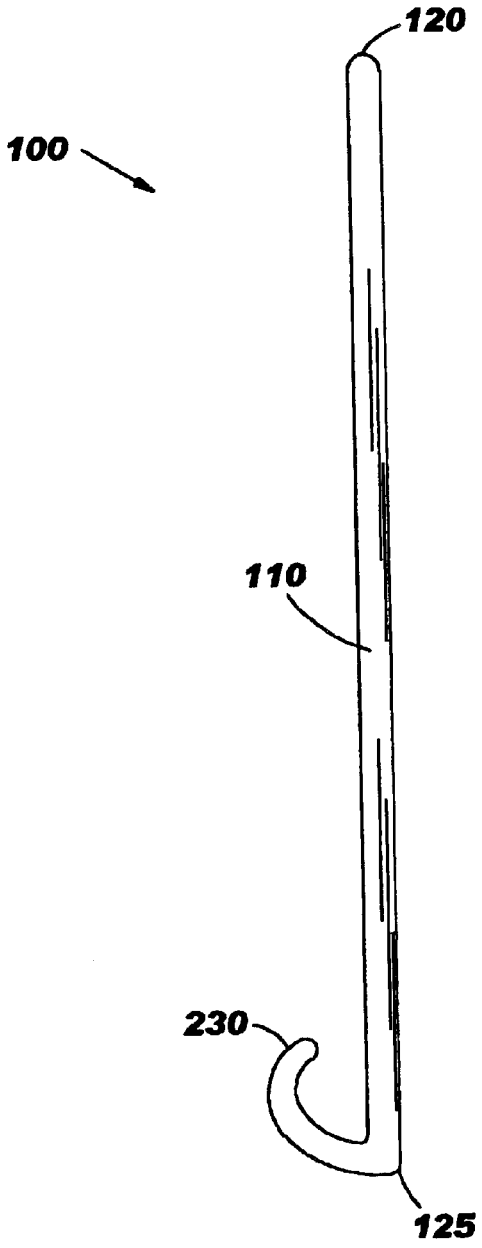

Referring to FIGS. 1, 2A, and 2B, a technician catcher safety device 100 includes a frame made from a pair of main lever arms 110 interconnected by a central connecting portion 120. Each main lever arm 110 divergently extends outward from the central connecting portion 120 such that the frame extends about a variety of circumferences of a columnar member, such as a pole, a tree trunk, and the like. The angle of divergence of the main lever arms 110 depends upon a variety of factors, such as the length of the central connecting portion 120, the shape of the central connecting portion 120, the length of each main lever arm 110, and a range of circumferences for which the safety device 100 is intended to be used for. Each main lever arm 110 includes an elbow 125 at an end opposite the central connecting portion 120. The elbow 125 connects the attached main lever arm 110 to an upwardly, extending arm 130 that has an angle α (shown as reference numeral 210 in FIG. 2A). As shown in FIG. 1, the angle a has a value of approximately seventy degrees (70°) relative to the central connecting portion 120 such that the upwardly, extending arm 130 functions as a "hook." The angle α, however, could alternatively be any range from about more than thirty degrees (30°) to about less than one hundred twenty degrees (120°).

Figure 3:
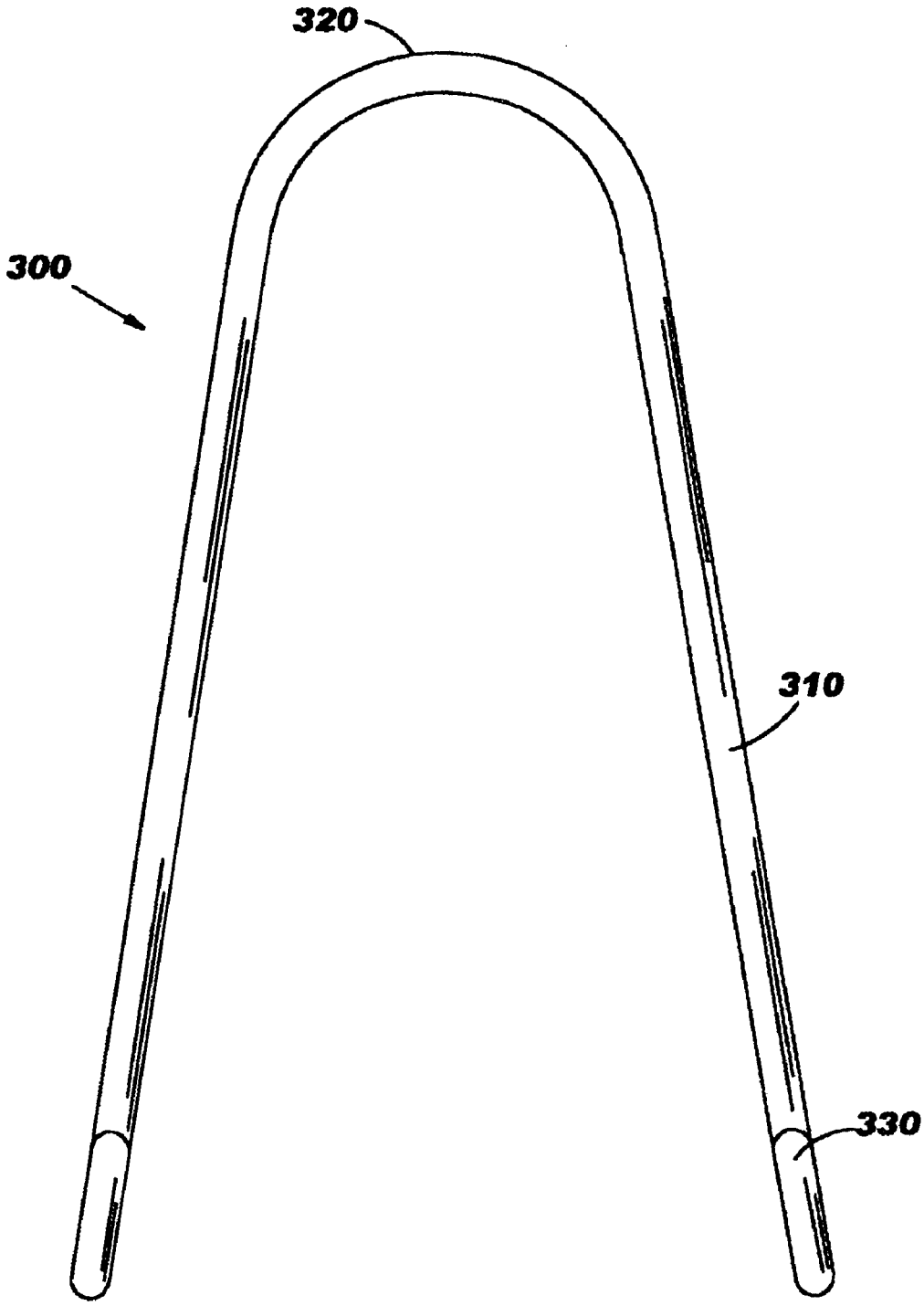
FIG. 3 is a perspective top view of another technician catcher safety device according to an embodiment of this invention.
Figure 4:
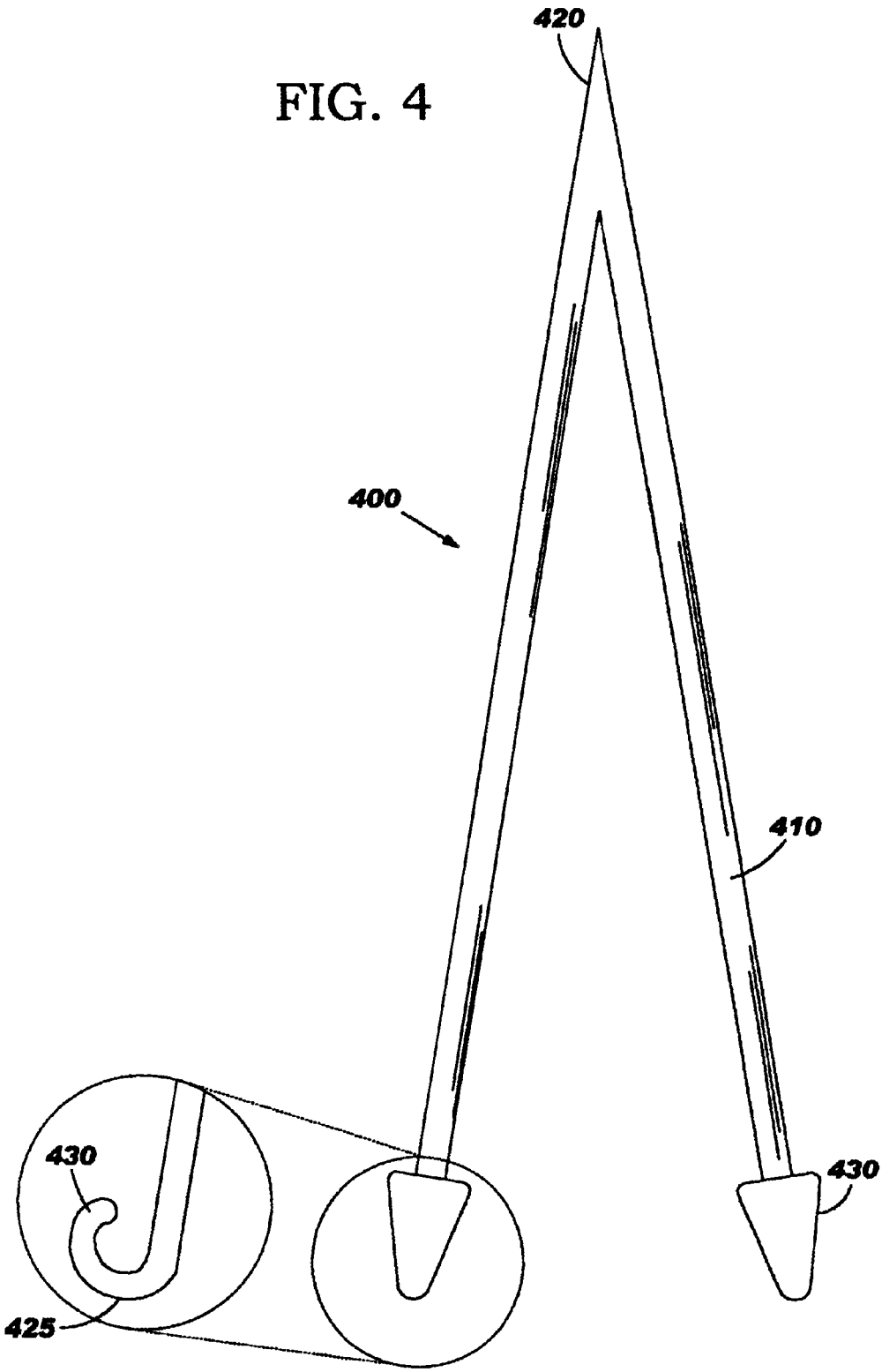
FIG. 4 is a perspective top view of an alternate technician catcher safety device according to an embodiment of this invention.

As depicted in FIG. 1, the central connecting portion 120 has a substantially rectangular or square-shape; however, as one of ordinary skill in the art appreciates, the central connecting portion 120 may take on a variety of shapes. For example, FIG. 3 shows a technician catcher safety device 300 with a pair of main lever arms 310 and a central connecting portion 320 having a substantially "U"-shape; and FIG. 4 shows a technician catcher safety device 400 with a pair of main lever arms 410 and a central connecting portion 420 also having a substantially "U"-shape. Similarly, the upwardly, extending arms 130 may take on a variety of shapes (polygonal and/or non-polygonal). For example, FIG. 2B shows an upwardly, extending arm 230 having a shepard's hook shape; and FIG. 4 shows an upwardly, extending arm 430 having a triangular shape with the base portion curved towards a top surface of the main lever arm 110 and towards the central connecting portion 120. In this way the extending arm 430 has a spiral-like shape for increased securement of the technician.

In a preferred embodiment, a first internal width 132 of the ends of the main lever arms opposite the central connecting portion 120 is approximately fifteen (15) inches, a second internal width 122 of the central connecting portion 120 is approximately seven (7) inches, the length 112 of each main lever arm 110 is approximately twenty-three (23) inches, the angle α is approximately seventy (70°) degrees, and the length 225 of the upwardly extending arms is approximately six (6) inches. Alternatively, as one of ordinary skill in the art appreciates, these measurements may vary so long as the technician catcher safety device 100 supports the weight of a fallen technician as herein described. In addition, the technician catcher safety device 100 may be manufactured using any appropriate material that can support the weight of a technician (as well as an increased weight applied with the force of a fall) and also withstand a wide range of temperatures, humidity, moisture, and other environmental conditions. For example, the technician catcher safety device 100 can be formed of steel tubing, titanium, aluminum, and other appropriate, lightweight metals. The technician catcher safety device 100 may also have a durable finish coating, such as polyurethane powder. Alternatively, the technician catcher safety device 100 could be constructed of other appropriate metal, polymer, plastic, composite, ceramic, glass, crystal, and/or other appropriate materials and combination capable of being used as herein described.

Figure 5:
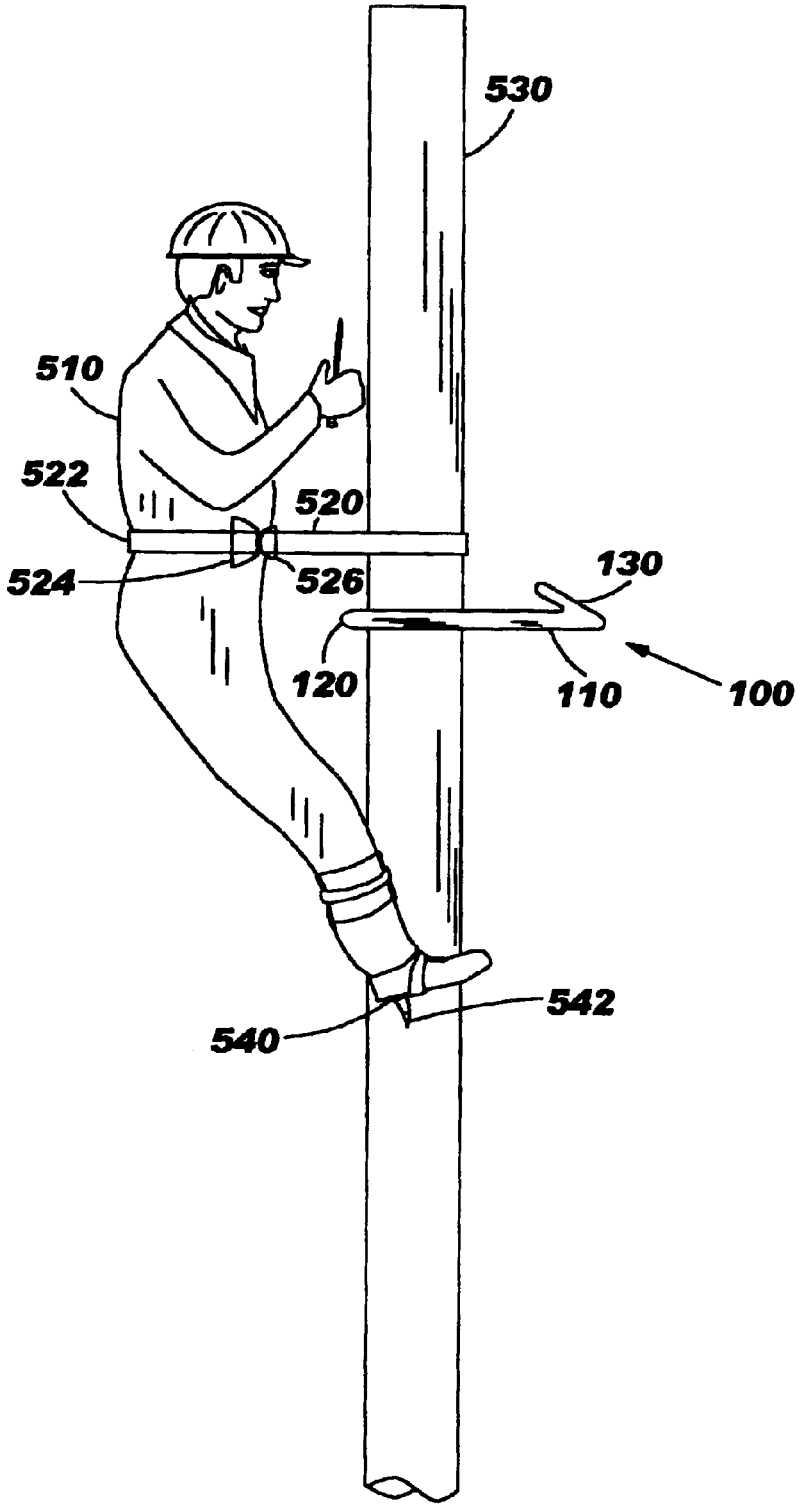
FIG. 5 illustrates a perspective side view of an elevated, secured technician with the technician catcher safety device of FIG. 1 positioned below and proximate to a safety strap secured to the technician according to an embodiment of this invention.
Figure 6:
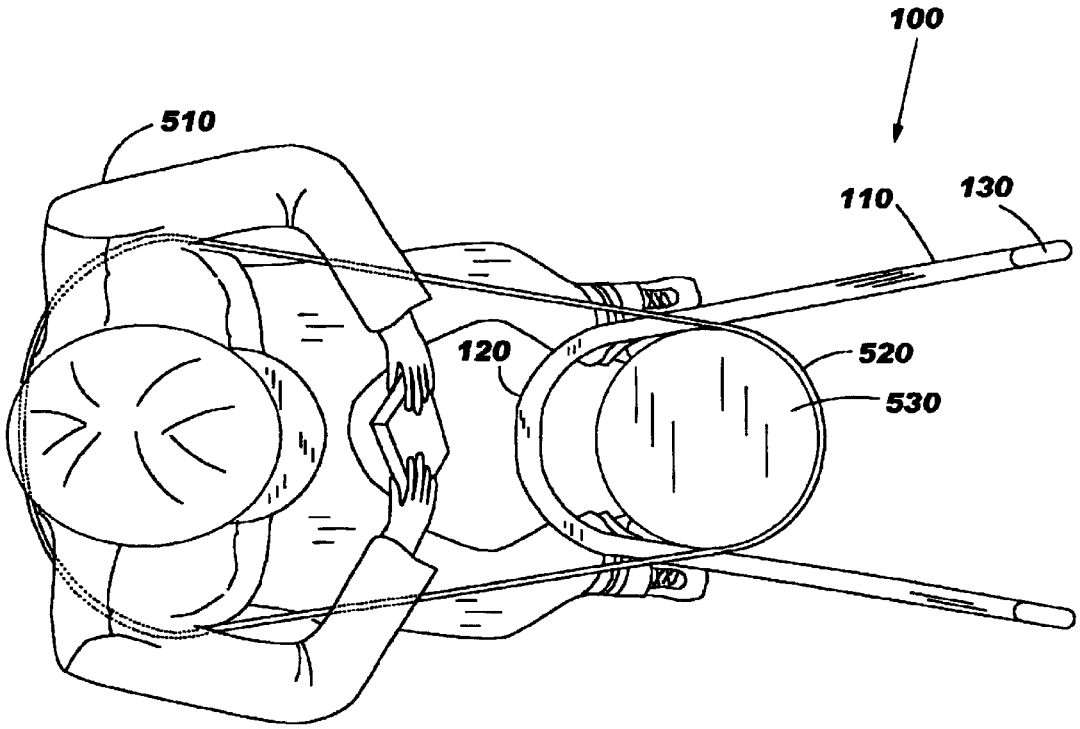
FIG. 6 illustrates a perspective top view of the elevated, secured technician with the technician catcher safety device of FIG. 1 positioned below and proximate to the safety strap secured to the technician according to an embodiment of this invention.
Figure 7:
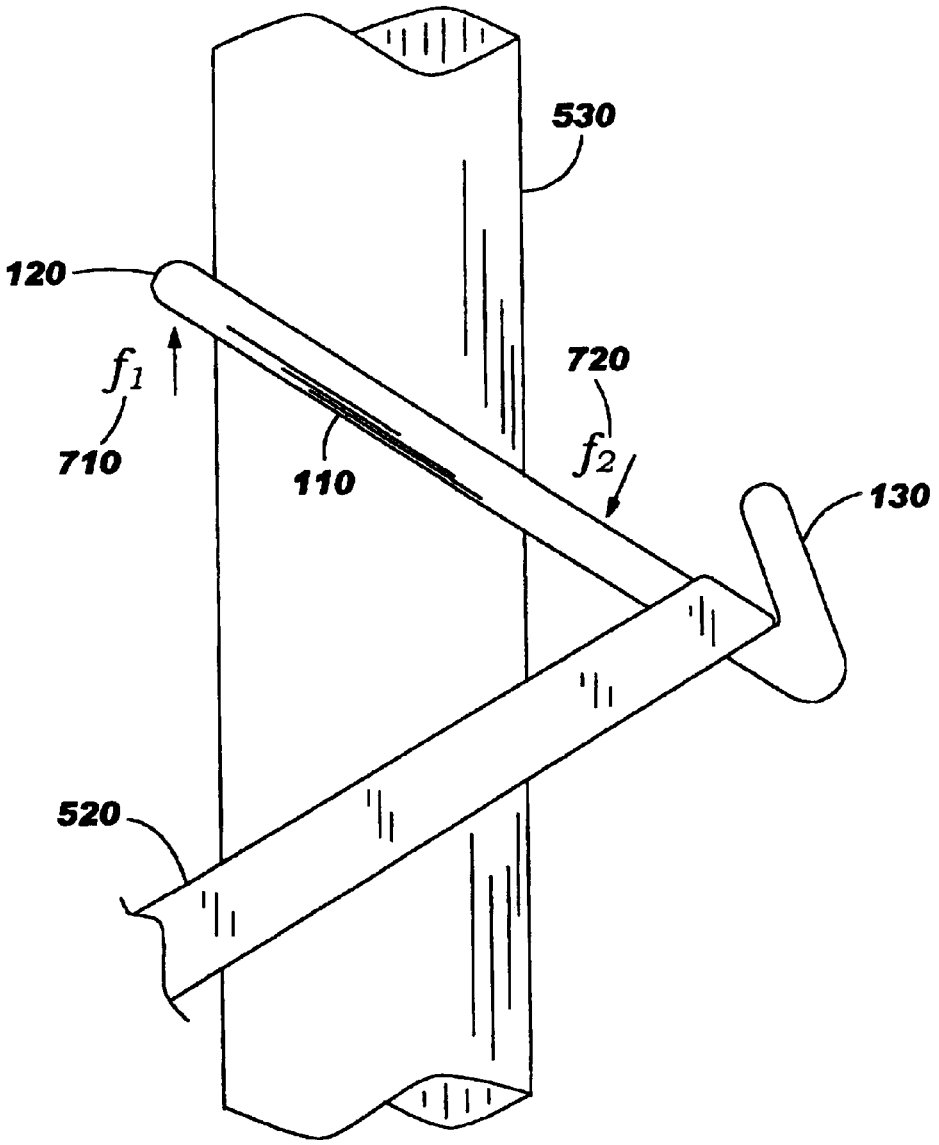
FIG. 7 illustrates a perspective side view of the technician catcher safety device of FIG. 1 supporting the safety strap of a fallen technician according to an embodiment of this invention.

Typically, the technician catcher safety device 100 is used as generally shown in FIGS. 5–7. When performing elevated work, a technician 510 positions the technician catcher safety device 100 below and proximate to a safety strap 520 extending about a pole 530. Examples of elevated work include, but are not limited to installation, maintenance, testing, and/or other types of repair work on suspended equipment, such as terminals, wire pouches, J-hooks, network cable, transformers, and/or other types of hardware and equipment used by the telecommunications and/or electrical industry. In general, the pole 530 may be any type of pole, such as for example, a telephone pole, an electrical pole, a tree trunk, and the like. In most cases, the pole 530 is tapered, such that a diameter of an upper portion of the pole 530 is less than the diameter of a lower portion of the pole 530.

As shown, the technician 510 wears a body belt 522 secured about the technician's waist. The body belt 522 includes a pair of locking members, shown as D-ring 524. The D-rings 524 or alternate locking members (not shown) engage corresponding attachment members 526 (also shown as D-rings) on the ends of the safety strap 520. The safety strap 520 extends around the pole 530 and connects with the body belt 522 worn by the technician 510. When the D-rings 524 of the body belt 522 are engaged with the attachment members 526 of the safety strap 520, the technician 510 may use the safety strap for climbing as well as supporting the technician 510 in a desired working position on the pole 530. In addition, the technician 510 utilizes gaffs 540 having a bladed portion 542 that are driven into and that penetrate the pole 530 to prevent the feet of the technician 510 from slipping and to assist with climbing. When the technician 510 is in the desired working position to perform elevated work, the weight of the technician 510 is supported by the gaffs 540 and by the safety strap 520 such that the technician may freely use his hands to perform the elevated work.

Once the technician 510 reaches a desired working position on the pole 530, the technician 510 positions the technician catcher safety device 100 below and proximate to the safety strap 520 with a center of the central connecting portion 120 facing the technician's body such that the upwardly extending arms 130 are positioned on the side of the pole 530 opposite the technician's body. The technician catcher safety device 100 is positioned by when the technician 510 pushes the technician catcher safety device to wedge the main lever arms 110 about the circumference of the pole 530 to frictionally engage the pole 530 such that the technician catcher safety device 100 maintains a desired position below and proximate to the safety strap 520 as shown in FIGS. 5 and 6.

Figure 8:
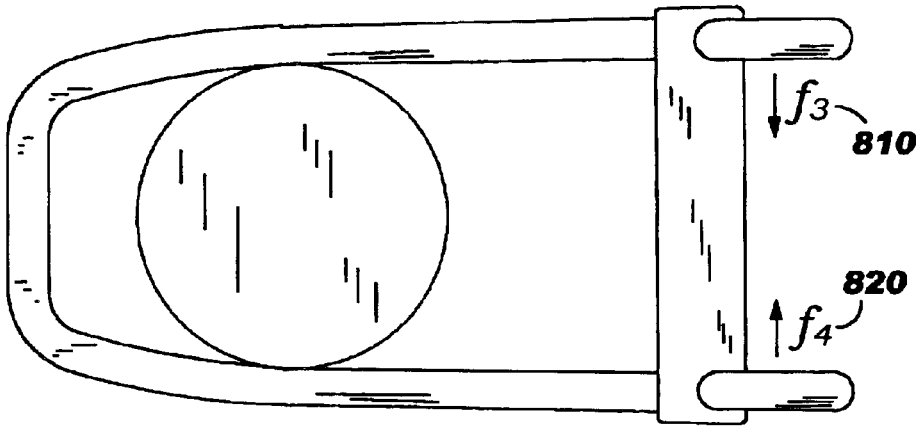
FIG. 8 illustrates a perspective top view of the technician catcher safety device of FIG. 1 supporting the safety strap of a fallen technician according to an embodiment of this invention.

FIGS. 7 and 8 illustrate exploded perspective side and top views of the technician catcher safety device 100 supporting the safety strap 520 of a fallen technician (not shown). When the technician falls, the safety strap 520 is caught by the main lever arms 110, and the safety strap 520 moves and/or slides towards an inside surface of the elbow 120. When the safety strap 520 slides to the elbow 120, the weight of the fallen technician exerts a downward force $f_1$ (shown as reference numeral 710). This downward force $f_1$ acts on the elbow 120 and creates a responsive upward force $f_2$ (shown as reference numeral 720). This responsive force $f_2$ acts on the central portion 120. In addition, the safety strap 520 exerts two additional forces $f_3$ and $f_4$ (shown, respectively, as reference numerals 810 and 820 in FIG. 8) on or proximate to the ends of the main lever arms 110 proximate to the elbow 120. These forces, $f_3$ and $f_4$ squeeze the ends of the main lever arms 110 together such that the technician catcher safety device 100 frictionally engages the pole 530 to a secured, stationary position. The technician catcher safety device 100 thus supports the weight of the fallen technician and prevents the technician from falling to the ground (or alternate lower surface). The technician catcher safety device 100 helps prevent or reduce resultant injuries that may have been caused by the impact of the fall to the ground.

Figure 9:
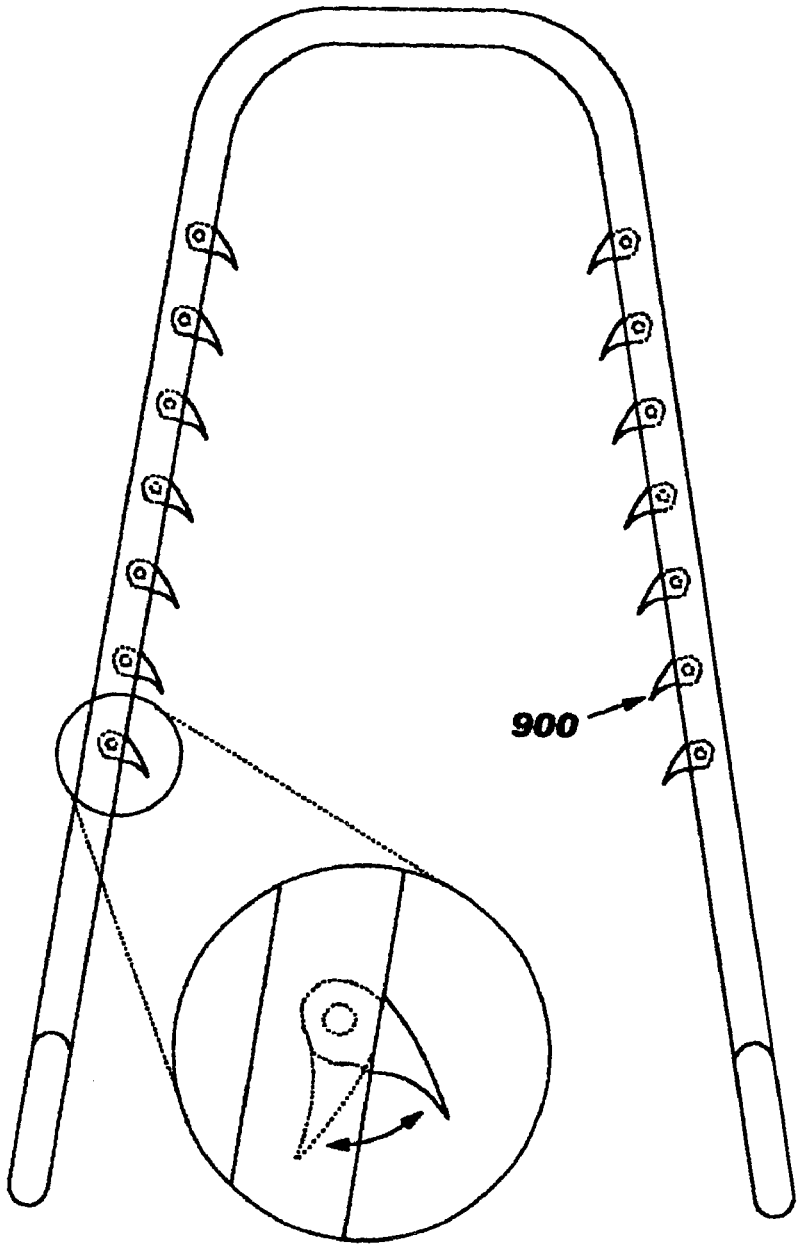
FIG. 9 is a perspective top view of the technician catcher safety device of FIG. 1 including attached gaffs according to another embodiment of this invention.
Figure 10:
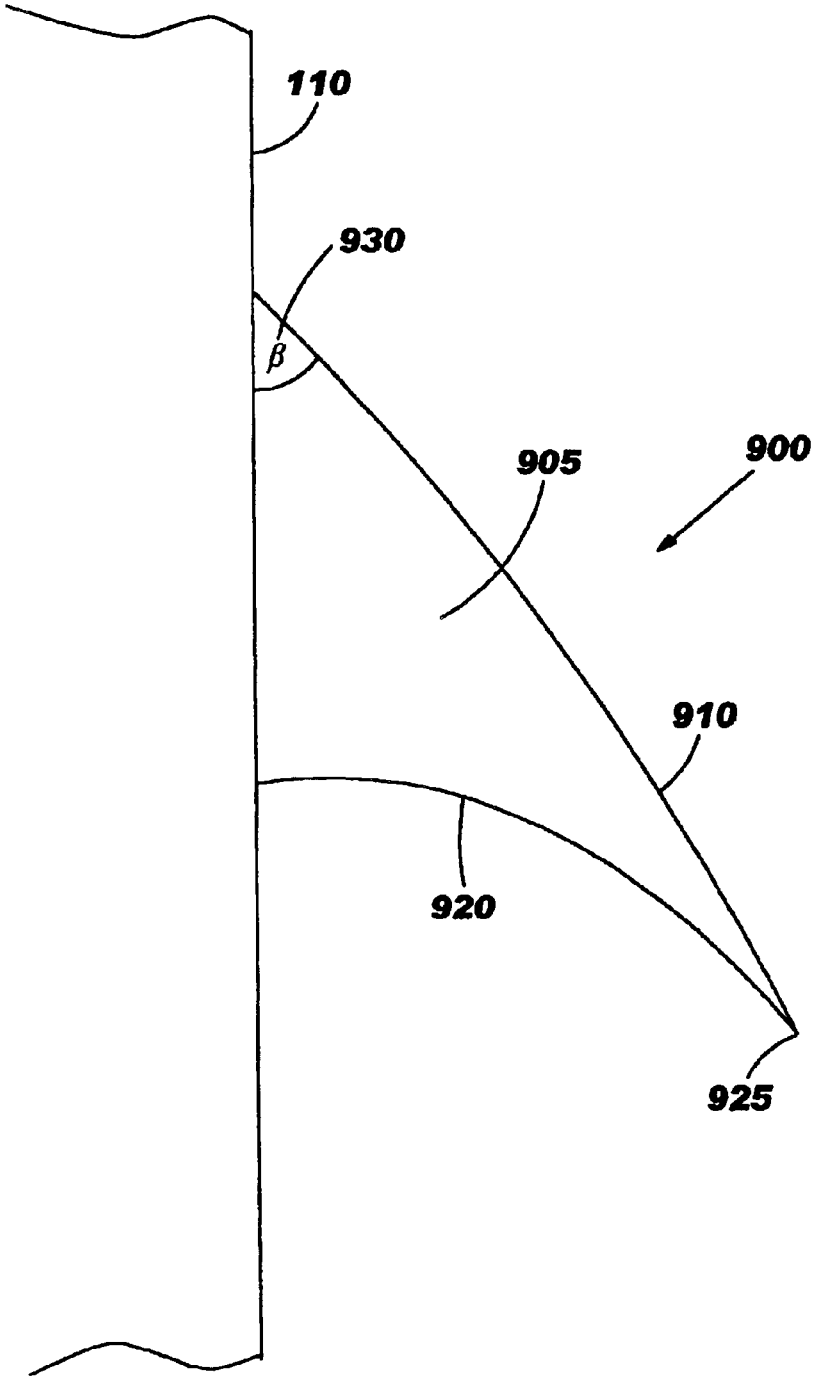
FIG. 10 is a perspective side view of an attached gaff of FIG. 9.

In addition to the above described embodiments, the technician catcher safety device 100 may further include one or more toothed gaffs 900 along an inward surface of the each main lever arm 110 as shown in FIGS. 9 and 10. The toothed gaff 900 is adapted for biting engagement into the wood or other material of the pole 530. As shown in FIG. 10, the toothed gaff 900 has a generally triangular shaped surface 905 having a hypotenuse 910 extending from a surface of the main lever arm 110 at an angle β (shown as reference numeral 930) of preferably at least fifteen degrees. The leg 920 opposite angle β may be a curved, bladed surface having a tip 925 for further facilitating biting into the material of the pole. Further, the toothed gaff 900 may retract into the inward surface of the main lever arm 110 such that the toothed gaff 900 is only extended when positioned about the pole 530. Alternatively, the toothed gaffs may extend at different angles and/or have different shapes so as to firmly secure the technician catcher safety device 100 to the pole 530 when the toothed gaffs 900 further engage the material of the pole 530 when the technician 510 falls. In another alternative embodiment, the inward surface of the technician catcher 100 may include a bladed edge that similarly engages the material of the pole 530.

Figure 11:
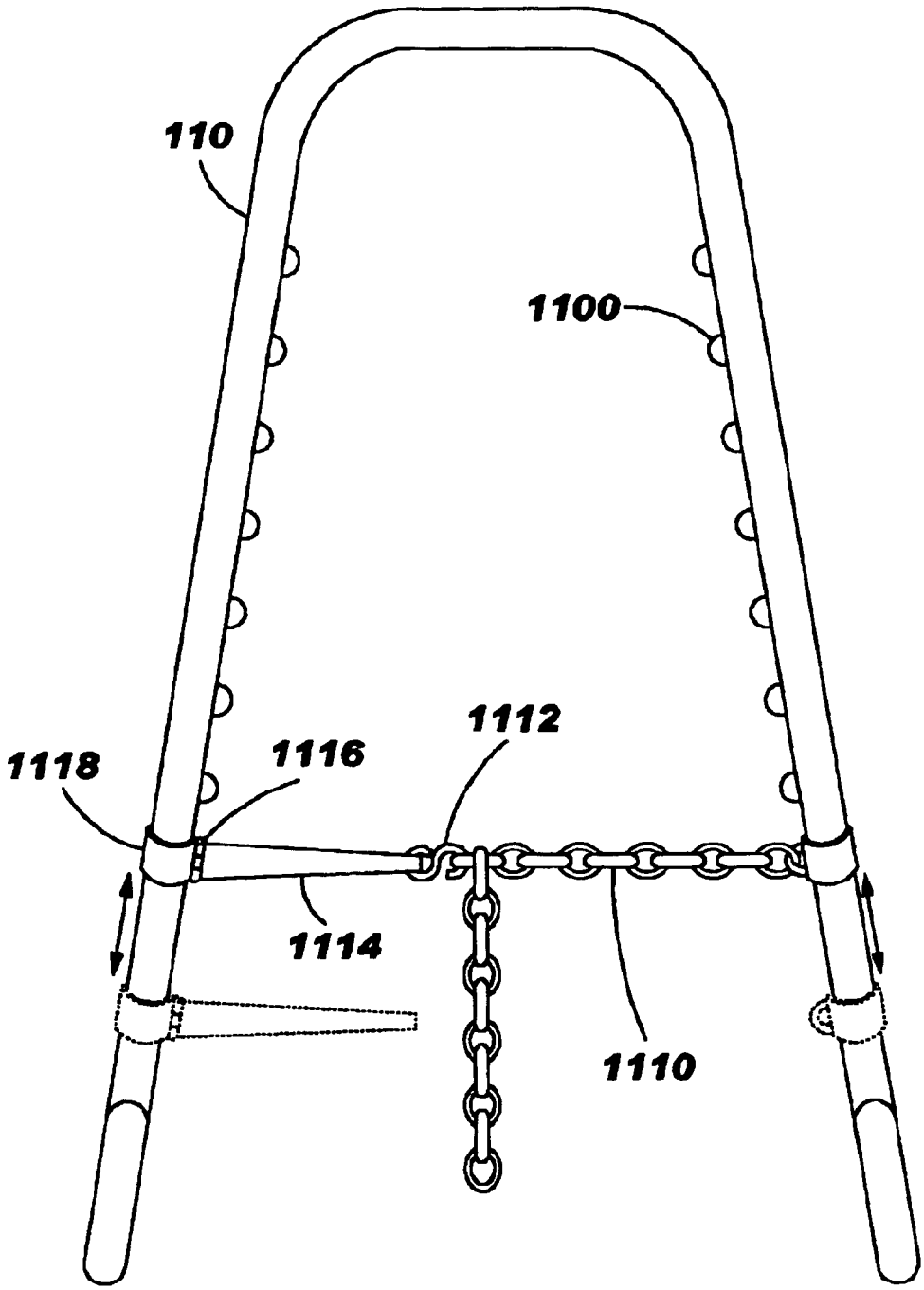
FIG. 11 is a perspective top view of an alternate technician catcher safety device according to an embodiment of this invention.

Still further, the technician catcher safety device 100 may further include one or more ridge-like gripping surfaces 1100 along an inward surface of the each main lever arm 110 as shown in FIG. 11. Each of the ridge-like gripping surfaces 1100 facilitate engagement of the material of the pole 530 when the technician 510 falls; however, the ridge-like gripping surface 1100 may be safety handled by the technician 510 such as when the technician 510 uses a hand to grip the main lever arm 110 and to carry the technician catcher 100 up the pole 530. FIG. 11 also shows chain means secured to one of the main lever arms 110 and a mating link supporting arm 1114. The chain means include a linked chain 1110 securely attached at a first end of the linked chain to the one of the main lever arms 110. The link supporting arm 1114 pivotally secures 1116 at an end to the other main lever arm 110 and has a clip 1112 at an opposite end. In general, the end of the link supporting arm 1114 is securely positioned by arm engagement means 1118 on a portion of the other main lever arm 110 substantially opposite the chain means, such that the clip 1112 detachably engages a link of the linked chain 1110 to securely adjust the technician catcher 100 into a desired position about the pole 530. The arm engagement means 1118 may include a nut, a bolt, a screw, a rivet, and/or welding to secure the link supporting arm 1114 to the main lever arm 110. In addition, the arm engagement means 1118 and the chain means may by adjustable up or down the length of main lever arm 110 to better secure about various circumferences of the pole 530.

Figure 12:
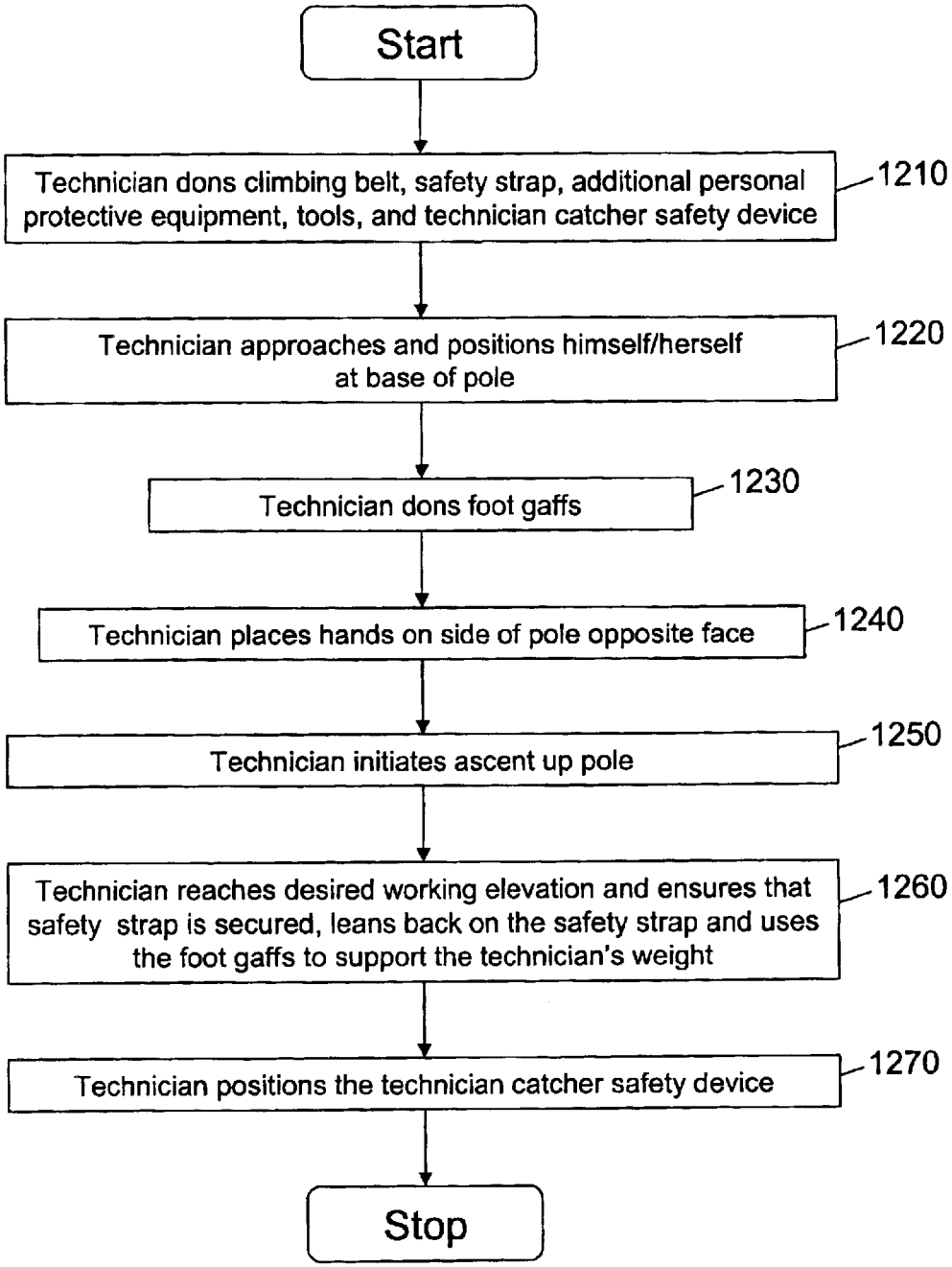
FIG. 12 is a flowchart of a method for using the technician catcher safety device according to an embodiment of this invention.

In addition to the above embodiments, this invention includes a method of positioning the technician catcher safety device and/or a method of supporting or otherwise holding a fallen technician using the technician catcher safety device as herein described. As shown by the flowchart of FIG. 12, the method may include the technician donning a climbing belt and safety strap on the technician's waist as well as putting on additional safety equipment (e.g., hard hat), tools, and the technician catcher safety device [block 1210]. The technician places himself at the base of the pole [block 1220] and dons the foot gaffs [block 1230]. Thereafter, the technician places his/her hands on the side of the pole opposite his/her face [block 1240] and initiates a hand-over-hand ascent up the pole [block 1250]. Once the technician reaches a desired working elevation (e.g., the desired work position), then the technician ensures that the safety strap is secured around the pole and may lean back on the strap and use the secured foot gaffs to support the technician's weight to maintain the position [block 1260]. Thereafter, the technician uses a free hand to position the technician catcher safety device below and proximate to the safety strap [block 1270]. If the technician should fall, then the technician catcher safety device catches the technician and supports the weight of the suspended technician from the safety strap.

Many modifications and other embodiments of the invention will come to mind to one skilled in the art to which this invention pertains having the benefit of the teachings presented in the foregoing descriptions and the associated drawings. For example, the main lever arms 110 may take on alternate shapes, such that they may be curved, flexible, or otherwise designed to position, support, or otherwise hold a fallen technician. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A safety device, comprising:

a frame having a pair of main lever arms interconnected by a central connecting portion, each main lever arm divergently extending from the central connecting portion such that the frame extends about a variety of circumferences of a columnar member, each main lever arm having an elbow at an end opposite the central connecting portion, the elbow connecting the main lever arm to an upwardly, extending arm relative to a horizontal position of the frame about the columnar member, wherein the pair of main lever arms are adapted to engage the columnar member in order to support a supended weight from each elbow, wherein each of the main lever arms comprises at least one toothed gaff on an inward surface of the main lever arm, and wherein the substantially triangular shaped toothed gaff retracts into the inward surface of the relative main lever arm.

2. The safety device of claim 1, further comprising:

chain assembly secured to one of the main lever arms, the chain means comprising a linked chain securely attached at a first end of the linked chain to the one of the main lever arms; and a link supporting arm pivotally secured at a first end of the link supporting arm to the other main lever arm and having a clip at a second end of the link supporting arm, the first end of the link supporting arm position on a portion of the other main lever arm substantially opposite the chain assembly, such that the clip detachably engages a link of the linked chain to securely adjust the frame into a desired position about the columnar member.

3. The safety device of claim 2, wherein the chain assembly comprises means for attaching the first end of the linked chain to the one of the main lever arms, the means for attaching comprising at least one of the following:

a nut;

a bolt;

a screw;

a rivet; and welding.

4. The safety device of claim 1, wherein the central connecting portion comprises a substantially rectangular-shaped central connecting portion.

5. The safety device of claim 1, wherein the central connecting portion comprises a substantially "U"-shaped central connecting portion.

6. The safety device of claim 1, wherein the central connecting portion comprises a substantially V shaped central connecting portion.

7. The safety device of claim 1, wherein a length of the main lever arm is approximately twenty-three inches.

8. The safety device of claim 1, wherein a length of the upwardly extending arm is approximately six inches.

9. The safety device of claim 1, wherein an internal width of the central connecting portion is approximately seven inches.

10. The safety device of claim 1, wherein an internal width of the elbows is approximately fifteen inches.

11. The safety device of claim 1, wherein each of the main lever arm comprises at least one toothed gaff on an inward surface of the main lever aim.

12. The safety device of claim 1, wherein the toothed gaff comprises a substantially triangular shaped toothed gaff having an interior angle relative to the inward surface and the central connecting portion of at least approximately fifteen degrees.

13. The safety device of claim 12, wherein the substantially triangular shaped toothed gaff comprises a bladed end curved inwards towards the inward surface.

14. The safety device of claim 1, wherein the upwardly, extending arm comprises an angle of at least thirty degrees relative to the central connecting portion.

15. The safety device of claim 1, wherein the upwardly, extending arm comprises an angle of at most one hundred thirty degrees relative to the central connecting portion.

16. The safety device of claim 1, wherein the frame comprises at least one of the following materials:

metal, polymer, plastic, ceramic, composite, glass, and crystal.

17. A method of positioning a safety device, comprising the steps of:

ascending a columnar member to a desired working elevation;

positioning the safety device to frictionally engage the columnar member, the safety device positioned below and proximate a safety strap attached to a body belt of a technician, the safety device comprising a frame having a pair of main lever arms interconnected by a central connecting portion, each main lever arm divergently extending from the central connecting portion such that the frame extends about a variety of circumferences of a columnar member, each main lever arm having an elbow at an end opposite the central connecting portion, the elbow connecting the main lever arm to an upwardly, extending arm relative to a horizontal position of the frame about the columnar member, wherein the pair of main lever arms are adapted to engage the columnar member in order to support a suspended weight from each elbow, wherein each of the main lever arms comprises at least one toothed gaff on an inward surface of the main lever arm, and wherein the substantially triangular shaped toothed gaff retracts into the inward surface of the relative main lever arm; and catching a fallen technician, wherein the pair of main lever arms engage the columnar member to support at least a suspended weight of the fallen technician when both a downward force and an inward force are exerted proximate to each elbow by the safety strap.

* * * * *